US008899242B2

(12) United States Patent
Wong

(10) Patent No.: US 8,899,242 B2
(45) **Date of Patent: *Dec. 2, 2014**

(54) EYES MAKE-UP APPLICATION MACHINE

(75) Inventor: Charlene Hsueh-Ling Wong, Taipei (TW)

(73) Assignee: Zong Jing Investment, Inc., Taipei (TW)

( * ) Notice: Subject to any disclaimer, the term of this patent is extended or adjusted under 35 U.S.C. 154(b) by 80 days.

This patent is subject to a terminal disclaimer.

(21) Appl. No.: 13/584,983

(22) Filed: Aug. 14, 2012

(65) Prior Publication Data

US 2013/0216295 A1 Aug. 22, 2013

(30) Foreign Application Priority Data

Feb. 20, 2012 (TW) ..... 101105516 A

(51) Int. Cl.
*A45D 40/26* (2006.01)

(52) U.S. Cl.
USPC ..... 132/218; 132/333; 132/320

(58) Field of Classification Search
USPC ..... 132/73, 73.6, 200, 333, 212, 286, 294, 132/314; 434/377, 99, 100; 345/629, 582; 601/17–18; 700/90, 264, 245, 161, 700/213, 231, 302, 233; 702/1, 127, 155, 702/167–168; 382/115, 117–118, 153–154, 382/199, 266; 222/144; 705/27.2
See application file for complete search history.

(56) References Cited

U.S. PATENT DOCUMENTS 3,570,500 A * 3/1971 Berry ..... 132/213
4,128,317 A * 12/1978 LeCover ..... 351/245
4,434,467 A * 2/1984 Scott ..... 700/90
4,864,966 A * 9/1989 Anderson et al. ..... 427/265
5,125,731 A * 6/1992 Fiorini et al. ..... 351/245
5,298,844 A * 3/1994 Nagasaki et al. ..... 318/568.11
5,460,192 A * 10/1995 McClain ..... 132/333
5,495,338 A * 2/1996 Gouriou et al. ..... 356/402

(Continued)

FOREIGN PATENT DOCUMENTS

DE 202004003148 U1 3/2005
DE 102005020938 A1 11/2006

(Continued)

OTHER PUBLICATIONS

Australia Office Action dated Jul. 16, 2013.

(Continued)

*Primary Examiner* — Rachel Steitz
*Assistant Examiner* — Jennifer Gill
(74) *Attorney, Agent, or Firm* — McClure, Qualey & Rodack, LLP

(57) ABSTRACT

An eye make-up application machine is provided, which includes a cosmetics provider in an eyeshade. The control device can control the cosmetics provider to move to a make-up application utility into position in order to spray or apply cosmetic materials to a contour corresponding to a human eye. Thus, the invention can provide an automatic make-up application utility for variously and accurately carrying out a makeup-application on eyes selected or emulated by one or more users. An eye contour image in the invention can be provided by an internal or external storage device or image recognition device. A plurality of makeup-application profiles can be provided by an internal or external storage device or be edited by the user as an option.

19 Claims, 9 Drawing Sheets

(56) References Cited

U.S. PATENT DOCUMENTS

| | | | | |
|---|---|---|---|---|
| 5,645,884 | A * | 7/1997 | Harlow et al. | 427/8 |
| 5,785,960 | A * | 7/1998 | Rigg et al. | 424/63 |
| 5,836,872 | A * | 11/1998 | Kenet et al. | 600/306 |
| 5,948,502 | A * | 9/1999 | Harden | 428/99 |
| 6,035,860 | A * | 3/2000 | Mombourquette | 132/200 |
| 6,095,156 | A * | 8/2000 | Smith, II | 132/286 |
| 6,199,557 | B1 * | 3/2001 | Laughlin | 132/200 |
| 6,286,517 | B1 * | 9/2001 | Weber et al. | 132/73 |
| 6,298,862 | B1 * | 10/2001 | Laughlin | 132/200 |
| 6,302,122 | B1 * | 10/2001 | Parker et al. | 132/333 |
| 6,305,384 | B2 * | 10/2001 | Laughlin | 132/200 |
| 6,502,583 | B1 * | 1/2003 | Utsugi | 132/200 |
| 6,622,064 | B2 * | 9/2003 | Bartholomew et al. | 700/233 |
| 6,763,283 | B1 * | 7/2004 | Murakami | 700/259 |
| 6,842,172 | B2 * | 1/2005 | Kobayashi | 345/419 |
| 6,886,572 | B2 * | 5/2005 | Laughlin | 132/333 |
| 7,079,158 | B2 * | 7/2006 | Lambertsen | 345/630 |
| 7,123,753 | B2 * | 10/2006 | Takahashi et al. | 382/117 |
| 7,329,003 | B2 * | 2/2008 | Nicolini | 351/244 |
| 7,634,103 | B2 * | 12/2009 | Rubinstenn et al. | 382/100 |
| 7,648,364 | B2 * | 1/2010 | Dauga et al. | 434/100 |
| D612,942 | S * | 3/2010 | Verdon-Roe | D24/172 |
| 8,061,365 | B2 * | 11/2011 | Rehkemper et al. | 132/73.6 |
| 8,082,926 | B2 * | 12/2011 | Yano et al. | 132/200 |
| 8,184,901 | B2 * | 5/2012 | Edgar et al. | 382/162 |
| 8,186,872 | B2 * | 5/2012 | Bartholomew et al. | 366/273 |
| 8,464,732 | B2 * | 6/2013 | Wong | 132/317 |
| 8,582,830 | B2 * | 11/2013 | Edgar et al. | 382/115 |
| 8,648,853 | B2 * | 2/2014 | Mordaunt et al. | 345/419 |
| 2002/0112738 | A1 * | 8/2002 | Parker et al. | 132/333 |
| 2002/0155069 | A1 * | 10/2002 | Pruche et al. | 424/47 |
| 2002/0195119 | A1 * | 12/2002 | Laughlin | 132/333 |
| 2004/0078278 | A1 | 4/2004 | Dauga et al. | |
| 2004/0110113 | A1 * | 6/2004 | Huang et al. | 434/100 |
| 2004/0143359 | A1 * | 7/2004 | Yogo et al. | 700/161 |
| 2005/0135675 | A1 * | 6/2005 | Chen et al. | 382/162 |
| 2006/0023163 | A1 * | 2/2006 | Foster | 351/246 |
| 2006/0032439 | A1 * | 2/2006 | Burato et al. | 118/712 |
| 2006/0033707 | A1 * | 2/2006 | Rodomista et al. | 345/156 |
| 2006/0049957 | A1 * | 3/2006 | Surgenor et al. | 340/825.19 |
| 2006/0098076 | A1 * | 5/2006 | Liang | 347/129 |
| 2006/0132506 | A1 * | 6/2006 | Utsugi | 345/646 |
| 2007/0197982 | A1 * | 8/2007 | Thomason et al. | 604/289 |
| 2008/0167674 | A1 * | 7/2008 | Bodduluri et al. | 606/187 |
| 2009/0025747 | A1 * | 1/2009 | Edgar et al. | 132/320 |
| 2009/0114236 | A1 * | 5/2009 | Mehta | 132/200 |
| 2009/0306484 | A1 * | 12/2009 | Kurtz et al. | 600/300 |
| 2010/0004569 | A1 * | 1/2010 | Kim et al. | 601/17 |
| 2010/0142755 | A1 * | 6/2010 | Brandewie et al. | 382/100 |
| 2010/0220933 | A1 * | 9/2010 | Takano et al. | 382/224 |
| 2010/0226531 | A1 * | 9/2010 | Goto | 382/103 |
| 2010/0243514 | A1 * | 9/2010 | Samain et al. | 206/581 |
| 2010/0252058 | A1 * | 10/2010 | Rehkemper et al. | 132/73 |
| 2011/0162673 | A1 * | 7/2011 | Samain et al. | 132/317 |
| 2011/0164263 | A1 * | 7/2011 | Samain et al. | 358/1.9 |
| 2011/0221657 | A1 * | 9/2011 | Haddick et al. | 345/8 |
| 2011/0221658 | A1 * | 9/2011 | Haddick et al. | 345/8 |
| 2011/0221659 | A1 * | 9/2011 | King et al. | 345/8 |
| 2011/0227813 | A1 * | 9/2011 | Haddick et al. | 345/8 |
| 2012/0027269 | A1 * | 2/2012 | Fidaleo et al. | 382/118 |
| 2012/0067364 | A1 * | 3/2012 | Wong | 132/200 |
| 2012/0158184 | A1 * | 6/2012 | Ma et al. | 700/264 |
| 2012/0223956 | A1 * | 9/2012 | Saito et al. | 345/582 |
| 2012/0271372 | A1 * | 10/2012 | Osorio | 607/17 |
| 2013/0089245 | A1 * | 4/2013 | Yamazaki et al. | 382/118 |
| 2013/0110101 | A1 * | 5/2013 | Van Valen et al. | 606/33 |
| 2013/0216295 | A1 * | 8/2013 | Wong | 401/195 |
| 2013/0223694 | A1 * | 8/2013 | Ricanek et al. | 382/118 |
| 2013/0314303 | A1 * | 11/2013 | Osterhout et al. | 345/8 |
| 2014/0039451 | A1 * | 2/2014 | Bangera et al. | 604/506 |
| 2014/0039452 | A1 * | 2/2014 | Bangera et al. | 604/506 |
| 2014/0039658 | A1 * | 2/2014 | Bangera et al. | 700/98 |
| 2014/0094945 | A1 * | 4/2014 | Hormann et al. | 700/95 |

FOREIGN PATENT DOCUMENTS

| | | | |
|---|---|---|---|
| GB | 2483973 | A | 3/2012 |
| JP | 09-169617 | | 6/1997 |
| JP | 2008-017936 | | 1/2008 |
| JP | 2011-244922 | | 12/2011 |
| JP | 3172833 | U | 1/2012 |
| JP | 2012-071126 | A | 4/2012 |
| KR | 20080086996 | A | 9/2008 |
| KR | 20100110693 | A | 10/2010 |
| WO | 2011/013450 | A1 | 2/2011 |
| WO | 2012/056744 | A1 | 5/2012 |

OTHER PUBLICATIONS

Extended European Search Report dated Jun. 19, 2013.
Germany Office Action dated Apr. 17, 2014.
France Search Report dated Sep. 12, 2013.
Japan Notice of Allowance dated Oct. 22, 2013.
Korea Notice of Allowance dated Aug. 20, 2013.
Netherlands Search Report Dated Aug. 10, 2012.
English translation of abstract of KR 20100110693 A (published Oct. 13, 2010).
English translation of abstract of KR 20080086996 A (published Sep. 29, 2008).
English translation of abstract of JP 2008-017936 (published Jan. 31, 2008).
English translation of abstract of JP 2011-244922 (published Dec. 8, 2011).
English translation of abstract of JP 09-169617 (published Jun. 30, 1997).
English translation of abstract of DE 202004003148 U1 (published Mar. 24, 2005).
English translation of abstract of JP 2012-071126 A (published Apr. 12, 2012).
English translation of abstract of DE 102005020938 (published Nov. 16, 2006).
English translation of abstract of JP 3172833 U (published Dec. 1, 2012).
English translation of abstract of WO 2012/056744 A1 (published May 3, 2012).
English translation of abstract of WO 2011/013450 A1 (published Feb. 3, 2011).

* cited by examiner

EYES MAKE-UP APPLICATION MACHINE

CROSS REFERENCE TO RELATED APPLICATION

This application claims the benefits of the Taiwan Patent Application Serial Number 101105516, filed on Feb. 20, 2012, the subject matter of which is incorporated herein by reference.

BACKGROUND OF THE INVENTION

1. Field of the Invention

The present invention relates to an eye make-up application machine, more particularly, to an eye make-up application machine with an input control of automatically applying cosmetics to human eyes.

2. Description of Related Art

Most people have an innate desire to appear attractive to others. Accordingly, many large companies have developed various care and make-up products for consumers to purchase. However, repeated practice is required in order to improve make-up skills and have makeup-applied eyes that are satisfactory and suited to the consumers themselves. In addition, various cosmetics and tools are purchased for different darkened eyebrows, eye shadows, eyelashes and eye liners. In this case, with different make-up capabilities and applied products, the make-up results between the actual and desired appearances are different for each consumer.

As various information technologies have been developed, typical color simulation devices are designed for a trial of make-up or care products on screen before a user buys and applies the products, thereby replacing the in-situ application of the products. However, such a make-up simulation device is big and hard to carry, and the simulated make-up still requires manual skills for applying facial and eye make-up. Hence, the actual make-up may not have the same effect as the simulated one displayed on screen.

Therefore, it is desirable to provide an improved device, especially for eyes, to mitigate and/or obviate the aforementioned problems conventionally in both manual make-up application and in the color simulation device for a trial of eye make-up.

SUMMARY OF THE INVENTION

The present invention provides an eye make-up application machine including an eyeshade, a moving module, a cosmetics provider, one or more image recognition devices, and a control device. The moving module is installed in the eyeshade and contains a moving block for a three-dimensional (3D) movement. The cosmetics provider is installed on the moving block of the moving module and has one or more cosmetic tools. The image recognition device is installed in the eyeshade and the image recognition device can take a picture and recognizes an eye contour image in the picture. The eye contour image can be a two-dimensional (2D) or a three-dimensional (3D) eye contour image. The image recognition device can be a charge coupled device (CCD), a complementary metal oxide semiconductor (CMOS) device, or an equivalent device, but those are preferably cooperated with a color video camera so as to automatize make-up application.

The control device is installed on the eyeshade and electrically connected to the moving module, the cosmetics provider and the image recognition device. The control device receives the eye contour image, drives the moving module to move the cosmetics provider to a make-up application position corresponding to the eye contour image, and drives the cosmetic tools within the cosmetics provider to select make-up according to a makeup-application profile. The makeup-application profile indicates an expected color makeup corresponding to the eye contour image. The control device can further receive a signal from the image recognition device in order to adjust the make-up application position.

Thus, the eye makeup-application machine of the present invention can automatically and accurately provide various make-up applications selected or emulated by one or more users. The actual make-up may not have too much difference from the simulated one displayed on screen, so the user will not feel disappointed.

The cosmetics provider may include a rotor which immovably or movably configures on the moving block. The rotor is equipped with one or more outlets containing one or more cosmetic tools. One or more cosmetic tools are selected from a group consisting of an eyeliner, a brush, a pressure nozzle, and a piezoelectric nozzle and each contain one or more cosmetic materials. The eyeliner can be an eye pencil, a wax-based eye pencil, a liquid eyeliner, a powder-based eye pencil, or an equivalent required for applying eye liner. The brush can be, for example, an eye shadow brush, an eyebrow brush, or an equivalent required for applying eye shadow or eyebrow shape. The pressure nozzle and the piezoelectric nozzle can jet a single color material or three primary color materials, red (R), green (G), blue (B) to be mixed into various colors or produce a gradient color effect. Thus, the color richness of the cosmetic materials is increased. The cosmetic materials can be a powder, foam, gel, liquid, or solid cosmetic material, or combinations thereof, for example; an eyebrow material, an eyeliner liquid, an eyeliner gel, an eye shadow, or an eye shadow cream.

The present invention further comprises a tool container installed in the eyeshade. The tool container comprises one or more backup cosmetic tools with one or more backup cosmetic materials. The cosmetics provider may correspondingly comprise a pick-or-place device. When there is need to use the backup cosmetic tools to provide makeup, the cosmetics provider moves to the tool container and uses the pick-or-place device to pick up one of the backup cosmetic tools. Therefore, the present invention can increase the possibility of using more cosmetic tools or cosmetic materials. The backup cosmetic tools can be selected from a group consisting of an eyeliner, a brush, and a pressure nozzle as mentioned before. The backup cosmetic materials can be one or combinations of the cosmetic materials mentioned above.

The control device can edit the eye contour image to the makeup-application profile, or do further editing of the makeup-application profile.

The control device may comprise an input interface. The eye contour image or the makeup-application profile can be provided by an external storage device or by an internal storage device configured in the machine. The internal storage device is electrically connected to the control device from inside, and the internal storage device can be a hard disk drive, compact disk drive, SD reader, MMS reader, or a built-in flash memory. The external storage device is electrically connected to the input interface of the control device from outside, and the external storage device can be a hard disk drive, USB flash drive, compact disk drive, SD reader, or MMS reader. Furthermore, the external storage device can be an external electronic device like a notebook, a PC, a tablet PC, a notebook, a mobile phone, a personal digital assistant (PDA), and/or an equivalent, which has an internal memory or a storage device.

The internal storage device and the external storage device may store the eye contour image or the makeup-application profile.

The abovementioned eye contour image can be obtained and pre-stored in the external storage device, or stored in a network drive for an internet download to the external storage device. Similarly, the makeup-application profile, which is satisfactory makeup-application profiles established in advance or eye contour images edited into satisfactory makeup-application profiles by users, can be pre-stored in the external storage device, or stored in a network drive for an internet download to the external storage device. Moreover, the makeup-application profile can combine the collected make-up templates of other users and the eye contour image of the user, so the user can establish a variety of makeup databases for use.

The present invention can further comprise a display electrically connected to the control device and show operating information or the eye images before and after applying eye makeup. The display can be a touch panel for displaying a human-machine interface thereon and installed in front of the eyeshade. A user can use the touch panel to maneuver the control device and to edit the eye contour image into the makeup-application profile, or to edit the makeup-application profile. Moreover, the user can input a program or an instruction through the touch panel to maneuver the control device to drive the moving module and the cosmetics provider to automatically apply eye makeup. The display can also be a common non-touch display and installed in front of the eyeshade. The eyeshade may further have a plurality of operating interfaces electrically connected to the control device and used to input a program or an instruction to the control device. The plurality of operating interfaces can be a traditional conventional mechanical switch, key, or knob, an equivalent operating interface, or a combination thereof. The display can be installed inside the eyeshade and can also be a touch panel or a common non-touch display. According to this, the operating interface can be a sensor set in the eyeshade, for example a g-sensor or an accelerator. The sensor can detect the movement or rotation of head and transfer the movement information into a program or an instruction to the control device.

The present invention can further comprise a distance-measuring device to provide the distance information between the cosmetics provider and the make-up application position so as to help the control device to drive and control the movement of the moving module. The distance-measuring device can be installed on the moving block of the moving module or other suitable places in the eyeshade. The distance-measuring device can be a laser ranger, a microwave radar, an infrared instrument, an ultrasonic instrument, or other equivalent distance-measuring device. The distance-measuring device outputs a distance-measuring light onto the eye of a user and receives a reflected light from the eye of the user. The distance-measuring device can provide the information of determining whether the movement of the moving module is in accordance with the subject make-up application position. In addition, when the eye contour image and the makeup-application profiles are 2D images, the distance-measuring device can provide a directional position signal and a position alignment signal of one axis in planar measurement in order to provide a position and alignment data of the other dimension in space, thereby changing the 2D image into a 3D image.

The present invention can further comprise a security sensor that can output an abnormal signal to the control device to interrupt the operation or immediately cut off the power when an abnormal state is detected, for instance, the cosmetic tool moves to the wrong make-up application position, the distance of the eye and the cosmetic tool is smaller than a secure distance, or the eyelid opens during application of eye shadow. The security sensor can be a pressure sensor, an optical isolator, a limit switch, a distance-measuring device, a CCD, a CMOS, a camera, or an equivalent. Accordingly, a user can prevent the cosmetic materials from being applied to the eye or to unwanted positions of the eye.

In the present invention, the input interface of the control device may electrically connect with an external electronic device. The external electronic device can drive and control the moving module and the cosmetics provider or edit the eye contour image taken by the image recognition device into the makeup-application profile. The external electronic device can be a notebook, a PC, a tablet PC, a netbook, a mobile phone, a personal digital assistant (PDA), and/or an equivalent. Accordingly, a user can edit or preview the simulated makeup-applied profile from the external electronic device so as to decide the suitable or desired make-up and further maneuver the control device for an automatic make-up application.

In the present invention, the moving module includes a horizontal rail, a vertical rail and a sliding platform. The moving block is installed on the sliding platform in order to move forward and back. The sliding platform is movably installed on the horizontal rail in order to move left and right. The horizontal rail is moveably installed across the vertical rail in order to move up and down. The moving module can be a multiple joint robot, a cylinder robot, a robot arm, an e-type robot, a c-type robot, or an auto-machine that can freely do three-dimensional movements.

In the present invention, the eyeshade includes a fastener, like earpieces, a belt, a band, a touch fastener, or an equivalent. The fastener is used to fasten the eyeshade to the head of the user corresponding to the eye in order to apply the eye make-up. Furthermore, the eyeshade may have gasket or sponges to protect the user's face when wearing the eyeshade.

DETAILED DESCRIPTION OF THE PREFERRED EMBODIMENT

Figure 1:
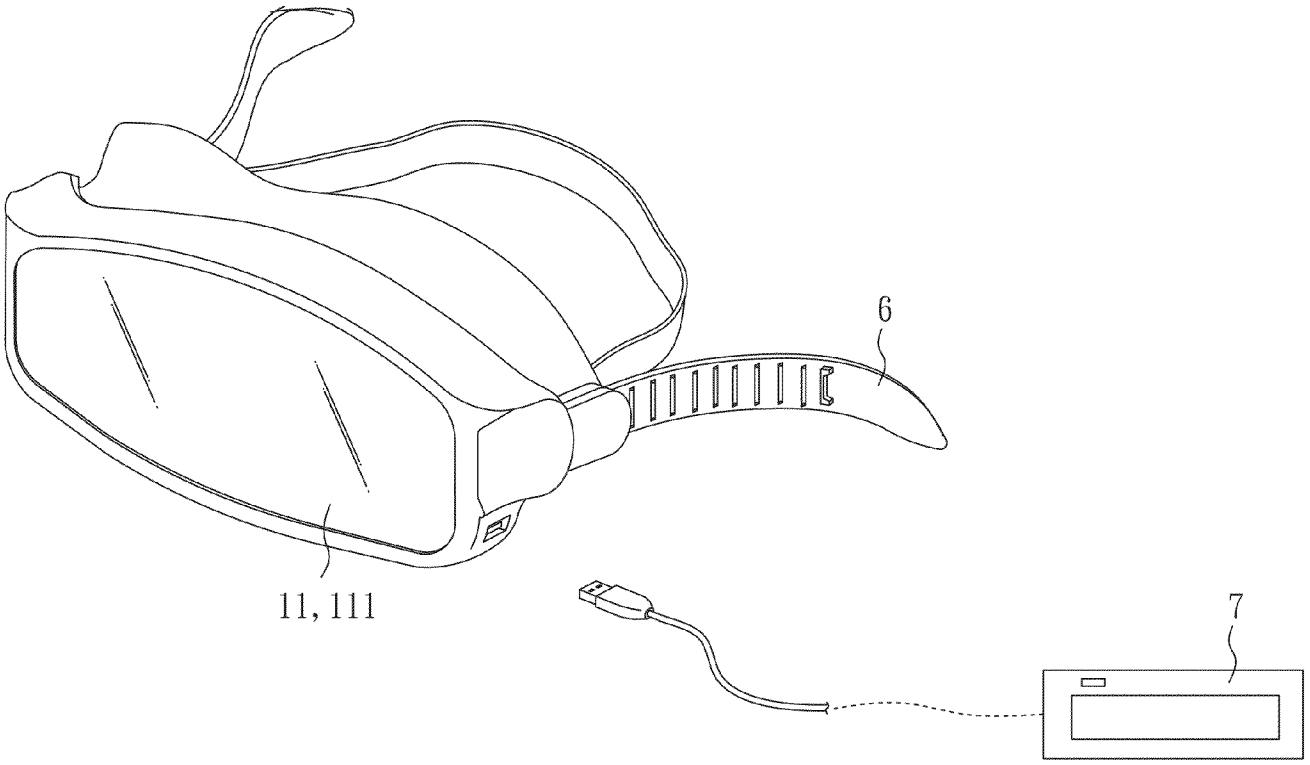
FIG. 1 is a perspective view of an eye make-up application machine according to a first preferred embodiment of the invention.
Figure 2:
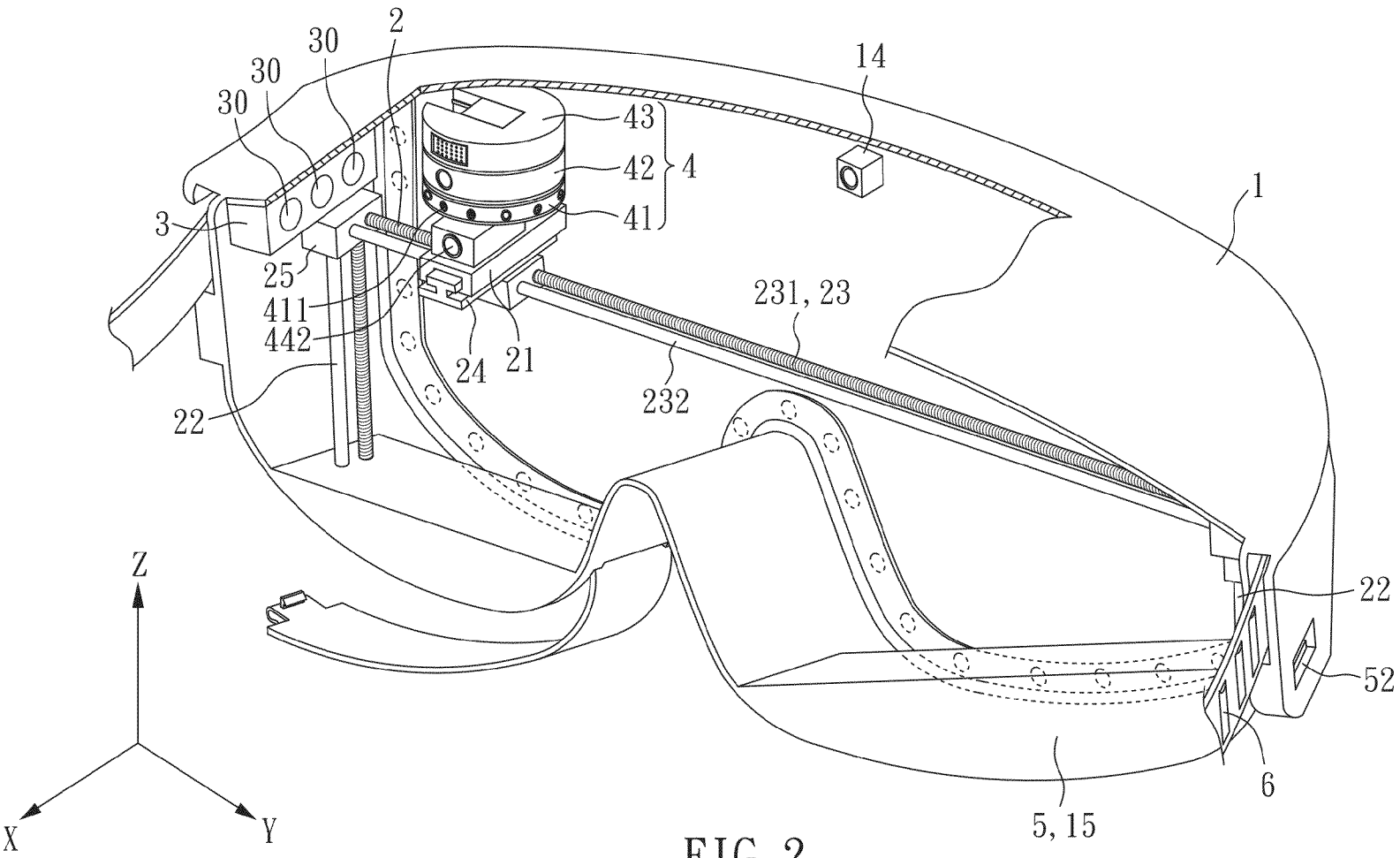
FIG. 2 is an exploded view of an eye make-up application machine according to the first preferred embodiment of the invention.
Figure 3:
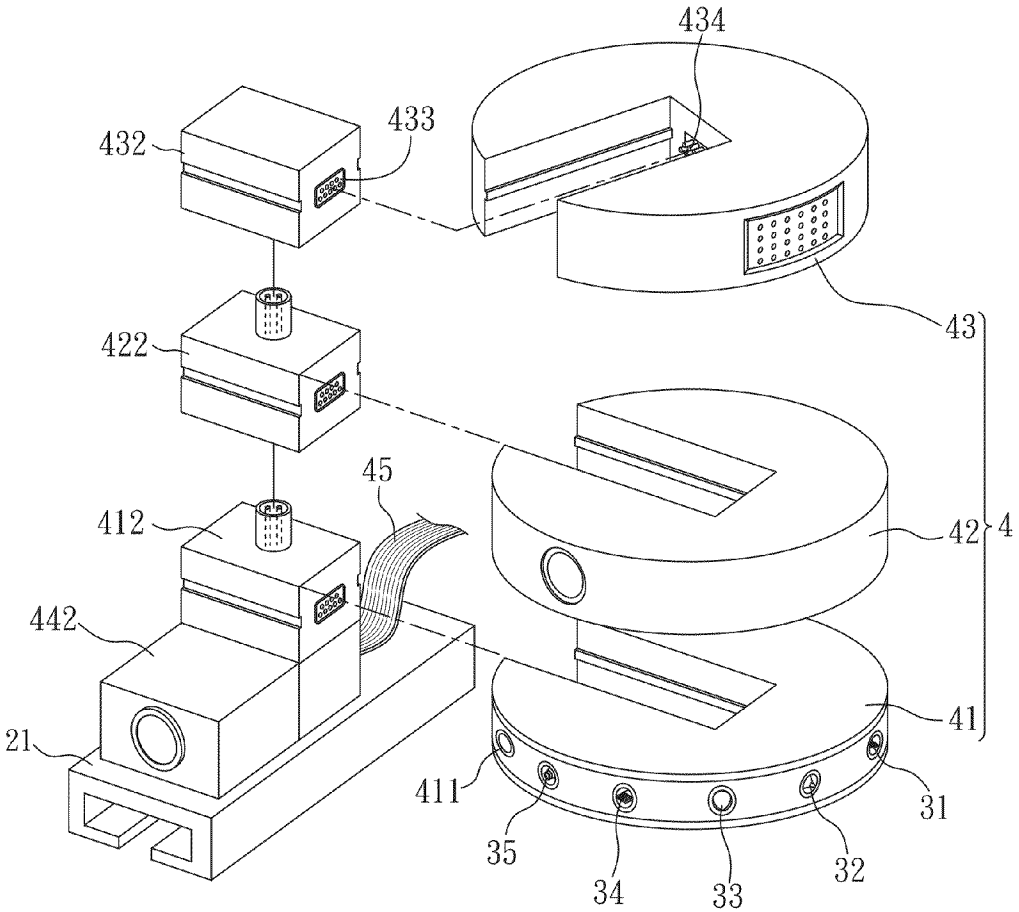
FIG. 3 is an exploded view of a cosmetics provider according to the first preferred embodiment of the invention.

FIG. 1 is a perspective view of an eye make-up application machine according to a first preferred embodiment of the invention. FIG. 2 is an exploded view of FIG. 1. FIG. 3 is an exploded view of a cosmetics provider according to the first preferred embodiment of the invention. As shown in FIGS. 1-3, the machine of the present example includes: an eyeshade 1, a display 11, a moving module 2, a tool container 3, a cosmetics provider 4, a control device 5, an image recognition device 14, an internal storage device 15, a distance-measuring device 442, and a fastener 6. As shown in FIGS. 1 and 2, the eye shade may be in the form of a goggle. As shown in FIG. 2, the moving module 2 includes a horizontal rail 23, a vertical rail 22, a sliding platform 24 and a moving block 21. The moving block 21 is installed on the sliding platform 24 in order to move along the X-axis. The sliding platform 24 is movably installed on the horizontal rail 23 in order to move along the Y-axis. The horizontal rail 23 is moveably installed across the vertical rail 22 in order to move along the Z-axis. Accordingly, the moving block 21 can move in a 3D space. The vertical rail 22 and the horizontal rail 23 both have two rods, for example, the horizontal rail 23 includes a screw 231 and a guide rod 232. A driven device 25, such as a motor, is set between the vertical rail 22 and the horizontal rail 23 and can drive the guide rod 232 to rotate. Therefore, the moving block 21 set on the sliding platform 24 can move along the Y-axis according to the rotation of the guide rod 232. Similarly, the vertical rail 22 may have the same structure.

The display 11 shows a human-machine interface and is electrically connected to the control device. In this embodiment, the display 11 is a touch panel display 111 installed in front of the eyeshade 1.

Figure 4:
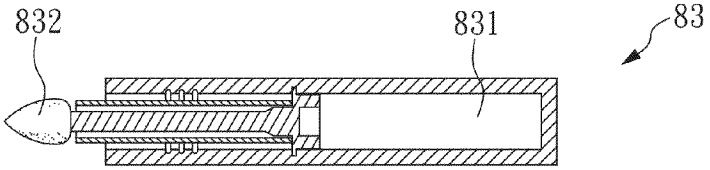
FIG. 4 is a side view of an eye shadow brush according to the first preferred embodiment of the invention.
Figure 5:
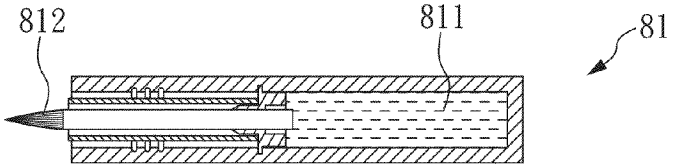
FIG. 5 is a side view of a liquid eyeliner according to the first preferred embodiment of the invention.

A tool container 3 installs in the eyeshade 1. A plural slot 30 of the tool container 3 comprises one or more backup cosmetic tools. Please refer to FIGS. 4 to 8, the figures show the side views of different cosmetic tools, for example, a liquid eyeliner 81, an eye pencil 82, an eye shadow brush 83, an eyebrow brush 84, and a pressure nozzle 85. The eye shadow brush 83 in FIG. 4 includes a color ink tube 831, and the tip 832 and the color ink tube 831 are bonded by a porous material, as known in a typical highlighter technique. Thus, the color inks outflow without pressing any discharge head when the tip 832 of the brush 83 is lightly slid. The liquid eyeliner 81 in FIG. 5 has liquid ink 811 in a tube. As known in a typical liquid eyeliner technique, the liquid ink 811 will outflow to a writing brush tip 812 via capillarity when the writing brush tip 812 is lightly slid.

Figure 6:
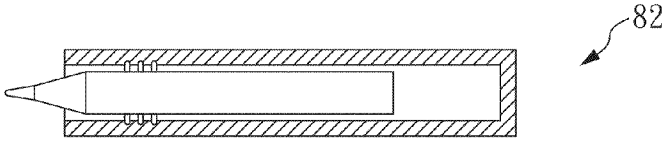
FIG. 6 is a side view of an eye pencil according to the first preferred embodiment of the invention.
Figure 7:
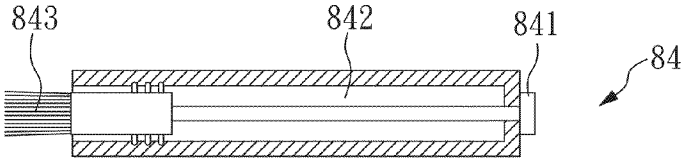
FIG. 7 is a side view of an eyebrow brush according to the first preferred embodiment of the invention.
Figure 8:
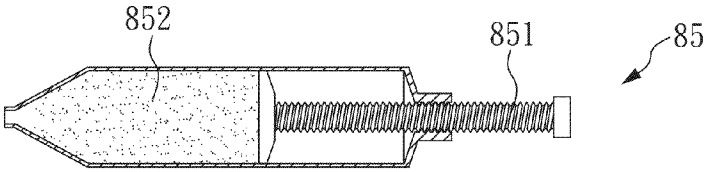
FIG. 8 is a side view of a pressure nozzle according to the first preferred embodiment of the invention.

The eye pencil 82 in FIG. 6 is a well-known eye pencil and can paint the eye line. The eyebrow brush 84 in FIG. 7 includes a rod 841 and has powder or dust cosmetic material 842 in the tube. Through push or pull of the rod 841, the cosmetic material 842 may attach to the brush 843. The pressure nozzle 85 in FIG. 8 has a driving device to drive a push rod 851 in rotation to thereby pressurize the internal liquid, gel, or nebulized cosmetic material 852 to jet out.

Referring to FIG. 2, the cosmetics provider 4 installs on the moving block 21 of the moving module 2 and comprises a rotor 41, a pick-or-place device 42, and a piezoelectric nozzle 43. As shown in FIG. 3, a distance-measuring device 442 and three prisms 412, 422, 432 install on the moving block 21. Each prism has a rotatable motor-like mechanism inside, so each prism can rotate independently. A cable 45 links behind the distance-measuring device 442 and is electrically connected to the control device 5. Therefore, the control device 5 can control the distance-measuring device 442, the rotor 41, the pick-or-place device 42, and the piezoelectric nozzle 43. The rotor 41 attaches to the prism 412, the pick-or-place device 42 attaches to the prism 422, and the piezoelectric nozzle 43 attaches to the prism 423. Each prism and each correspondingly connected device are electrically connected in order to provide the electricity and control signals and independently control the movement. For example, the prism 423 has a jack 433 and the piezoelectric nozzle 43 has a connector 434. When the piezoelectric nozzle 43 is attached to the prism 423, the connector 434 will electrically connect to the jack 433. The rotor 41 and the pick-or-place device 42 also have the same mechanism. Moreover, the user can change the rotor 41, the pick-or-place device 42, or piezoelectric nozzle 43 separately when need.

Figure 9:
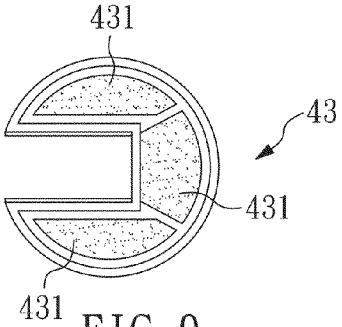
FIG. 9 is a side view of a piezoelectric nozzle according to the first preferred embodiment of the invention.

The rotor 41 has various outlets 411 installed in the perimeter of the rotor 41 for containing the cosmetic tools, such as a liquid eyeliner 31, an eye pencil 32, an eye shadow brush 33, an eyebrow brush 34, and a pressure nozzle 35. These cosmetic tools are like the liquid eyeliner 81, the eye pencil 82, the eye shadow brush 83, the eyebrow brush 84, and the pressure nozzle 85 mentioned before. Therefore, using the rotor 41, the user can easily change cosmetic tools, or conveniently apply various color materials or pigments for automatically applying make-up. The piezoelectric nozzle 43 can be driven by a known piezoelectric control technique in a typical printer to output the cosmetic materials in spray or liquid particles. The control device can effectively control the amount of cosmetic materials and the colors to be output. As shown in FIG. 9, the piezoelectric nozzle 43 has three primary color materials, red (R), green (G), blue (B) to be mixed into various colors or produce a gradient color effect. Thus, the color richness of the cosmetic materials is increased.

The abovementioned pick-or-place device 42 can have a gripping structure, a magnetic structure, or an equivalent pick-or-place structure. When required to pick-or-place the backup cosmetic tools in the plural slot 30 of the tools container 3, the cosmetics provider 4 installed on the moving module 2 moves to the tool container 3 and uses the pick-or-place device 42 to pick up one of the backup cosmetic tools contained in the slot 30. Therefore, the present invention can increase the possibility to use more cosmetic tools or cosmetic materials.

Figure 10:
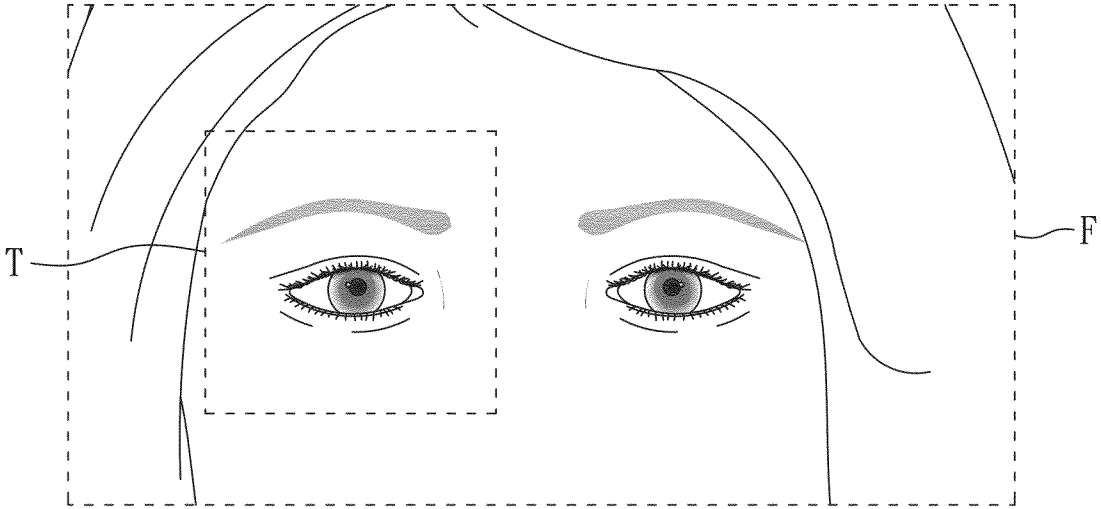
FIG. 10 is a schematic view of an eye contour image F according to the first preferred embodiment of the invention.
Figure 11:
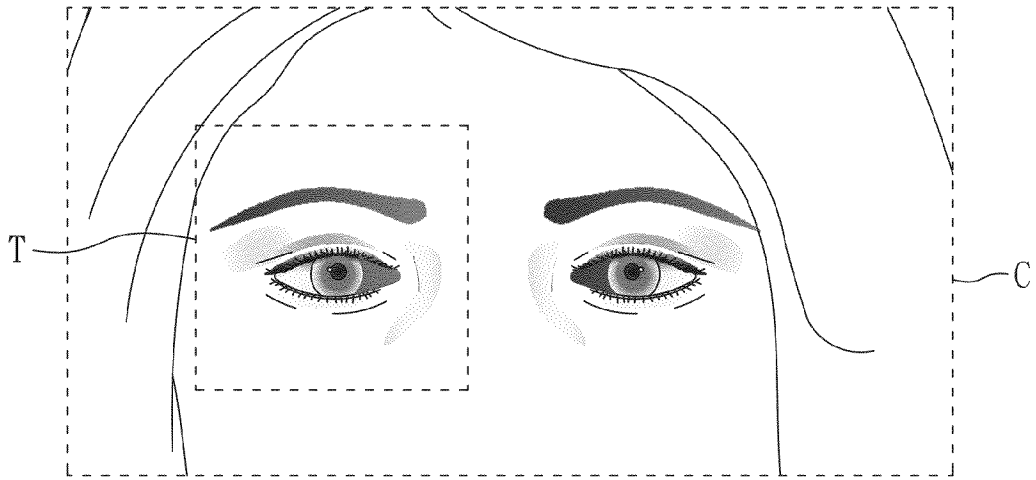
FIG. 11 is a schematic view of a makeup-application profile C and a make-up application position T according to the first preferred embodiment of the invention.

Referring to FIGS. 2, 10 and 11, FIG. 10 is a schematic view of an eye contour image F and FIG. 11 is a schematic view of a makeup-application profile C and a make-up application position T. The image recognition device 14 installs in the eyeshade 1 and is electrically connected to the control device 5. The image recognition device 14 can take a picture and recognizes an eye contour image F in the picture. In this embodiment, the eye contour image F taken by the image recognition device 14 is a 2D image. The distance-measuring device 43 can provide a third dimension position signal thereby changing the 2D image into a 3D image.

The control device 5 installs on the eyeshade 1 and is electrically connected to the moving module 2, the cosmetic provider 4 and the image recognition device 14 thereby driving the moving module 2 and the cosmetic provider 4 to automatically apply facial make-up. The control device 5 comprises an input interface 52 to receive the eye contour image F and the makeup-application profile C. The makeup-application profile C indicates an expected color makeup corresponding to the eye contour image F. The input interface 52 is an input port to receive an externally input eye contour image F or makeup-application profile C through connection to an external storage device 7, such as a hard disk drive, a USB flash drive, a compact disk drive, a SD reader, or a MMS reader. Furthermore, the external storage device 7 can be an external electronic device like a notebook, a PC, a tablet PC, a notebook, a mobile phone, a personal digital assistant (PDA), and/or an equivalent, which has an internal memory or a storage device.

In this embodiment, the eye contour image F and the makeup-application profile C can be a pre-made autodyne picture of a user that is input by an externally connected external storage device 7, or pre-stored in an internal storage device 15. The internal storage device 15 electrically connects to the input interface 52 from inside, pre-stores the eye contour image F, and can be a hard disk drive, compact disk drive, SD reader, MMS reader, or a built-in flash memory. The makeup-application profile C can use the pre-stored image, which is satisfactory makeup-application profiles established in advance or eye contour images F edited into satisfactory makeup-application profiles C by users and saved into the external storage device 7. Furthermore, by maneuvering the control device 5 through a human-machine interface shown on the touch panel display 111, the user can edit the eye contour image F taken by the image recognition device 14 into the makeup-application profile C or further edit the pre-stored makeup-application profile C.

The control device 4 can receive a program or command from the human-machine interface and control the moving module 2 to drive the cosmetic provider 4 to the make-up application position T corresponding to the eye contour image F to apply make-up. In this case, the make-up is applied on one upper eyelid, and the cosmetics provider 4 is moved to the make-up application position T and is driven to jet out the cosmetic material 431 through the piezoelectric nozzle 43 based on the makeup-application profile C.

During a make-up application operation, the distance-measuring device 442 can provide a position signal, such that can calibrate the movement of the moving module 2 accurately to the make-up application position T. The distance-measuring device 442 is an infrared ray ranger. The infrared ray ranger sends a distance-measuring light to the upper eyelid of the user and automatically receives the reflected light from the upper eyelid to correctly move the moving module 2 to the upper eyelid. The distance-measuring device 442 also can be a laser, ultrasound, or a well-known camera ranger. In addition, when the eye contour image F and make-up application profile C are a 2D image, the distance-measuring device 442 can provide an X-direction position signal and a position alignment signal in planar measurement in order to provide a position and alignment data of the other dimension in space, like the distance between the cosmetic provider 4 and the make-up application position T, thereby changing the 2D image into a 3D image. When the input is a 3D image, an X-axis position alignment signal can be also provided. When the upper eyelid make-up is applied, the eye contour image F and the make-up application profile C are provided at closed and open eye states.

In this embodiment, a security sensor is provided and combines the information of the distance-measuring device 442 and the image recognition device 14. When the security sensor detects abnormalities, for example, the cosmetic provider or eye are in the wrong position, the distance between the cosmetic provider and the eye is too short, or the eyelid is open while applying an eye shadow, the security sensor sends an abnormal signal through the control device 5 to interrupt the operation of the cosmetic provider 4. The security sensor can detect whether the eyelids are open. The security sensor sends an abnormal signal through the control device 5 to interrupt the operation of the cosmetic provider 4 when the eye under an eye shadow operation is open. The security sensor also can be a pressure sensor electrically connected to the control device 5 and is used to detect whether the eyeshade 1 is within the right place of the bridge of the nose. When the eyeshade 1 does not touch the accurate place of the bridge of the nose of the user, the security sensor can detect an abnormality due to the pressure change, so as to output an abnormal signal to the control device 5 to thereby control the cosmetics provider 4 not to provide the material. Furthermore, the security sensor can be alternately a button, so the user can press the button to send the abnormal signal to stop anytime during operation.

As shown in FIG. 1, the fastener 6 is used to fasten the eyeshade 1 to the head of the user corresponding to the eye in order to apply the eye make-up. In this embodiment, the fastener 6 is a flexible plastic band. The fastener 6 can also be earpieces, a belt, a band, a touch fastener, or an equivalent.

When the user uses the machine to apply an eye shadow make-up, first, the eye make-up application machine mentioned above is provided and powered on. A user can input an eye contour image F or a makeup-application profile C through the input interface 52 from the external storage device 7 to the control device 5, or directly extract an eye contour image F from the internal storage device 15 of the control device 5 in order to edit the eye contour image F as a desired makeup-application profile C. The edit can be done by the human-machine interface on the touch panel display 111. In this case, the preset eye shadow make-up and associated materials, colors, and proportions are selected to modify the makeup-application profile C. For example, the parameters of color, lighting, saturation, and contrast are added to automatically adjust and meet with the color requirement of the user. Next, the display 11 displays the makeup-application profile C after the simulation, such that the user can preview the eye shadow color or the texture of the applied cosmetics to decide if it is appropriate or meets with their requirement.

Next, the user selects a make-up application position T and fastens the eyeshade 1 to the head corresponding to the eye. Then, the user presses a start button to send a start signal to the control device 5, and the security sensor detects whether the operation is in a safe operation state. If the security sensor sends an abnormal signal, it indicates "no", i.e., the operation is in an unsafe operation state, and thus the operation is interrupted. Next, the control device 4 changes the make-up application position T of the makeup-application profile C into a control signal of the moving module 2 and the cosmetics provider 4 to control an application path of the moving module 2 and an automatic makeup-application operation of the cosmetic provider 4. Next, a directional position signal measured by the distance-measuring device 442 is input to the control device 5 for obtaining an alignment signal to align the axis-direction position which, in this case, indicates the X axis of FIG. 2. Next, the control device 5 controls the moving module 2 and the cosmetic provider 4 to perform the makeup application processing, i.e., detecting whether all make-up operations are complete. Further, it is determined whether an operation is in a safe state when one or more operations are not complete. The user moves the eyeshade 1 out when all make-up application operations are complete.

Such a way allows the user to use the eye make-up application machine to automatically complete a makeup application according to the preset eye contour image F and makeup-application profile C. This can save time and reduce efforts since no personal make-up skill is required and the operation of the machine is quite easy.

Figure 12:
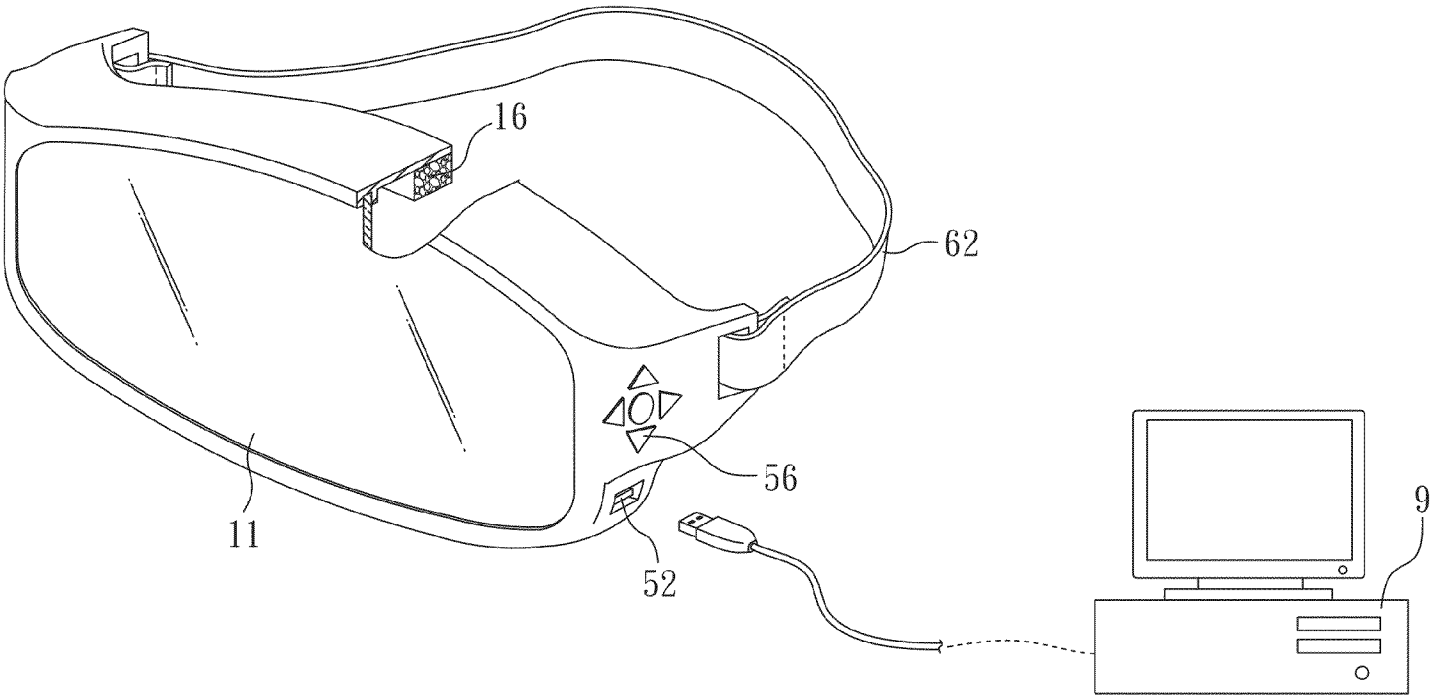
FIG. 12 is a perspective view of an eye make-up application machine according to a second preferred embodiment of the invention.

FIG. 12 is a perspective view of an eye make-up application machine according to a second preferred embodiment of the invention. The differences between the first and second embodiments are described as follows. The fastener 62 on the eyeshade 1 is a band and the eyeshade 1 has sponges to protect user's face when wearing the eyeshade 1. The display 11 installed in front of the eyeshade 1 is a common non-touch display and a plurality of operating interfaces 56 are installed on the side of the eyeshade 1, such as a five-way button or a plurality of buttons as shown. The user can use the five-way button to input a program or command to the control device 5 or combine the human-machine interface shown on the display 11 to edit the eye contour image F into the makeup-application profile C.

Moreover, the user can connect an external electronic device 9 to the input interface 52 of the eyeshade 1 in order to input a program or command to the control device 5, edit the eye contour image F into the makeup-application profile C, or input the eye contour image F and the makeup-application profile C to the control device 5. In this embodiment, the external electronic device 9 is a PC, but it also can be a notebook, a tablet PC, a netbook, a mobile phone, a personal digital assistant (PDA), and/or an equivalent.

Figure 13:
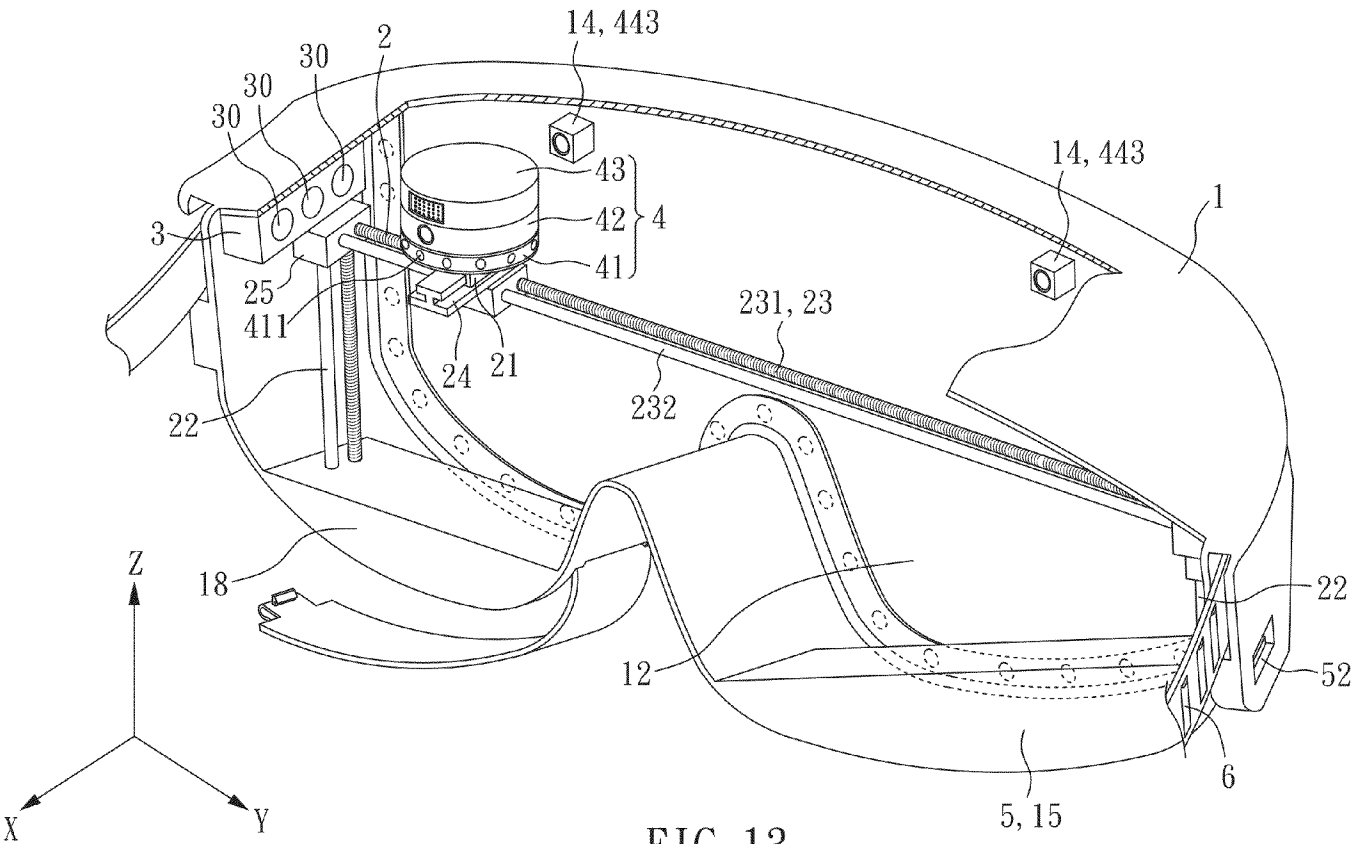
FIG. 13 is an exploded view of an eye make-up application machine according to a third preferred embodiment of the invention.

FIG. 13 is an exploded view of an eye make-up application machine according to a third preferred embodiment of the invention. The differences between the first and third embodiments are described as follows. An internal display 12 is installed in the eyeshade 1 electrically connected to the control device 5 and can be a touch panel or a common non-touch display. The eyeshade 1 can further install a sensor 18 electrically connected to the control device 5. The sensor 18 can be a G-sensor or an accelerometer and can detect the movement or rotation of the user's head and transfer the movement information into a program or an instruction to the control device 5.

In addition, two image recognition devices 14 are installed in the eyeshade 1 at the two sides corresponding to left and right eye in order to capture the eye contour image of the left and right eye independently. Thus, a user can just apply make-up to the left eye or right eye. In this embodiment, the image recognition devices 14 can directly capture a 3D eye contour image, so it can substitute for the distance-measuring device 442 in the first embodiment and provide the distance information to align the make-up application position of the moving module 2 during operation. Furthermore, the security sensor 443 in this embodiment is combined in two image recognition devices 14. When the image recognition devices 14 detect abnormalities, for example, the cosmetic provider or eye are in the wrong position, the distance between the cosmetic provider and the eye is too short, or the eyelid is open while applying an eye shadow, an abnormal signal sends to the control device 5 and interrupts the operation of the cosmetic provider 4. Additionally, the cosmetic provider 4 in this embodiment can be a removable device, and so the user can take off the rotor 41 or the piezoelectric nozzle to change the cosmetic tools or cosmetic materials contained inside.

As cited, the invention can actually improve the inconvenient manual makeup application by automatically applying makeup to the eye of a user, reduce the purchase cost of various cosmetics and associated tools, and variously embody eyes with makeup which the user selects or emulates in the machine. In addition, the devices of the machine can be miniaturized as a portable machine easy to carry.

Although the present invention has been explained in relation to its preferred embodiment, it is to be understood that many other possible modifications and variations can be made without departing from the spirit and scope of the invention as hereinafter claimed.

What is claimed is:

1. An eye make-up application machine, comprising:

an eyeshade in the form of a goggle;

a moving module installed in the eyeshade and having a moving block for a three-dimensional (3D) movement;

a cosmetics provider installed on the moving block of the moving module, the cosmetics provider has one or more cosmetic tools;

one or more image recognition device installed in the eyeshade, the image recognition device can take a picture and recognizes an eye contour image in the picture; and a control device installed on the eyeshade and electrically connected to the moving module, the cosmetic provider, and the image recognition device;

the control device receives the eye contour image, drives the moving module to move the cosmetics provider to a make-up application position corresponding to the eye contour image, and drives the cosmetic tools within the cosmetics provider to select make-up according to a makeup-application profile, the makeup-application profile indicating an expected color makeup corresponding to the eye contour image.

2. The eye make-up application machine as claimed in claim 1, wherein the cosmetics provider comprises a rotor with one or more outlets at its perimeter to contain the cosmetic tools.

3. The eye make-up application machine as claimed in claim 1, wherein the cosmetic tool of the cosmetics provider is one selected from a group consisting of an eyeliner, a brush, a pressure nozzle, and a piezoelectric nozzle.

4. The eye make-up application machine as claimed in claim 1, further comprising a tool container installed in the eyeshade, the tool container comprises one or more backup cosmetic tools with one or more cosmetic materials.

5. The eye make-up application machine as claimed in claim 4, wherein the cosmetics provider comprises a pick-or-place device, the cosmetics provider moves to the tool container and picks up one of the backup cosmetic tools.

6. The eye make-up application machine as claimed in claim 1, wherein the control device can further edit the makeup-application profile.

7. The eye make-up application machine as claimed in claim 1, wherein the control device comprises an hardware interface.

8. The eye make-up application machine as claimed in claim 7, further comprising an external storage device which has stored the eye contour image, the external storage device is electrically connected to the input interface of the control device from the outside.

9. The eye make-up application machine as claimed in claim 7, further comprising an external storage device which has stored the makeup-application profile, the external storage device is electrically connected to the input interface of the control device from the outside.

10. The eye make-up application machine as claimed in claim 1, further comprising an internal storage device installed in the eyeshade and being electrically connected to the control device, the internal storage device has stored the eye contour image.

11. The eye make-up application machine as claimed in claim 1, further comprising an internal storage device installed in the eyeshade and being electrically connected to the control device, the internal storage device has stored the makeup-application profile.

12. The eye make-up application machine as claimed in claim 1, further comprising a display showing a human-machine interface and being electrically connected to the control device.

13. The eye make-up application machine as claimed in claim 12, wherein the display is a touch panel installed in front of the eyeshade.

14. The eye make-up application machine as claimed in claim 1, further comprising a plurality of buttons installed on the eyeshade and electrically connected to the control device.

15. The eye make-up application machine as claimed in claim 1, further comprising a distance-measuring device installed on the moving block of the moving module, the distance-measuring device provides the distance information between the cosmetics provider and the make-up application position and helps the control device to drive and control the movement of the moving module.

16. The eye make-up application machine as claimed in claim 1, further comprising a security sensor, and the security sensor outputs a signal to the control device when at least one of a plurality of predetermined operating states of the cosmetics provider is detected.

17. The eye make-up application machine as claimed in claim 1, further comprising an external electronic device electrically connected to the control device for controlling the control device to drive and control the moving module and the cosmetics provider.

18. The eye make-up application machine as claimed in claim 1, wherein the moving module further comprises a horizontal rail, a vertical rail and a sliding platform, the moving block is installed on the sliding platform in order to move forward and back, the sliding platform is movably installed on the horizontal rail in order to move left and right, and the horizontal rail is moveably installed across the vertical rail in order to move up and down.

19. The eye make-up application machine as claimed in claim 1, wherein the eyeshade comprises a fastener, the fastener is used to fasten the eyeshade to the head of the user corresponding to the eye.

* * * * *